United States Patent [19]

Veltman et al.

[11] Patent Number: 4,882,994

[45] Date of Patent: Nov. 28, 1989

[54] PARTICULATE FUEL COMPONENTS FOR SOLID PROPELLANT SYSTEMS

[76] Inventors: Preston L. Veltman, 212 Old Country Rd., Severna Park, Md. 21146; Ove Hansen, 6560 Walnut Grove, Columbia, Md. 21045

[21] Appl. No.: 149,300

[22] Filed: Jan. 28, 1988

[51] Int. Cl.[4] ..... C06B 45/10; C06D 5/06

[52] U.S. Cl. ..... 102/290; 149/19.9; 149/19.92; 149/109.6; 264/3.4

[58] Field of Search ..... 149/19.9, 19.92, 109.6; 264/3.4, 3.6; 102/290

[56] References Cited

U.S. PATENT DOCUMENTS

| | | | |
|---|---|---|---|
| 3,899,973 | 8/1975 | Brocart | 102/27 R |
| 3,919,016 | 11/1975 | Dubrow | 149/60 |
| 4,099,376 | 7/1978 | Japs | 60/253 |
| 4,151,233 | 4/1979 | Fry, Jr. | 264/313 |
| 4,736,683 | 4/1988 | Bachman et al. | 102/290 |

OTHER PUBLICATIONS

Condensed Chemical Dictionary, p. 680, Van Nostrand Reinhold Co., N.Y., N.Y., 9th ed.

*Primary Examiner*—Peter A. Nelson

[57] ABSTRACT

A method for preparing free-flowing, particulate fuel components for use in solid propellant systems, which comprises dispersing fine-sized solid fuels in a latex of a polymer or polymer mixture, and spray drying the resultant dispersion.

16 Claims, No Drawings

PARTICULATE FUEL COMPONENTS FOR SOLID PROPELLANT SYSTEMS

FIELD OF THE INVENTION

The present invention relates to free-flowing, particulate fuel components for use in solid propellant systems, and to a method for making those fuel components.

BACKGROUND OF THE INVENTION

Solid propellant systems generally comprise a plastic material in admixture with a light metal, such as aluminum or beryllium, and a metal oxide, along with conventional compounding adjuvants, such as sulfur, accelerators, anti-oxidants, anti-ozonants and activators, and particles of a solid oxidizer, such as ammonium perchlorate. The various solids and the plastic material are blended together to form a plastic mass, which is formed into shapes and cured. The cured propellant systems must have certain essential characteristics in order to perform satisfactorily. For example, the cured system must burn evenly at approximately the same rate over all exposed surfaces, be sufficiently strong to withstand stresses developed during burning, and not crack or shatter either prior to or during the burning process. It is apparent that only a propellant system having a very high degree of homogeneity can perform satisfactorily.

Solid propellant compositions are fabricated into desired shapes by moulding, extruding or pressing formulations of several solids admixed in a plastic binder material. The binder materials utilized are generally thermoplastic resins and/or resins which may be cured by chemical cross-linking reactions. High shear devices capable of separating fine-sized particles from each other are generally employed to obtain a homogeneous blend of the solids and the plastic binder prior to fabricating the blend into the shape desired.

In practice, the oxidizer provides the major portion of the volume of the propellant system, and the fuel and binder occupy the void spaces between the relatively large oxidizer particles. The primary particles of the fuel are orders of magnitude smaller in size than the oxidizer particles, and this fact makes necessary that extensive time and energy be expended in shear mixing the various components of the blend to obtain the necessary degree of homogeneity. Quality control of the operation is difficult, and once binder curing agents are added to the blend, there is a limited amount of time available before the blend becomes solid and incapable of being moulded into pellets or other such shapes.

Prior to blending, the fuel particles, e.g., carbon or aluminum, are generally mixed or coated with a resinous binder to form an agglomerate. The agglomerate is generally formed by coating particles of the fuel with the resin dissolved in an organic solvent or by dry-blending the fuel with the binder. Representative prior art procedures are described below.

DISCUSSION OF THE PRIOR ART

In U.S. Pat. No. 4,256,521, metal powders of nodular, flaky, irregular or acicular shape are granulated with a synthetic resin binder to build up a porous agglomerate having a size range of 100 to 2,500 microns having an apparent density of between 0.4 and 1.1. The porous metal powder agglomerates are formed by conventional granulating means which subject the metal powder and resin binder feed to a rolling or mixing motion or both.

In U.S. Pat. No. 4,452,145, thermoplastically deformable elastomers are deposited on particles of the oxidant from a solution containing the elastomer.

U.S. Pat. No. 4,361,526 describes an overall process for preparing solid propellant systems utilizing a thermoplastic elastomer as the binder. The process involves: (1) dissolving an elastomer in an excess of a volatile solvent; (2) adding and mixing an aziridine compound as a binding agent in the thermoplastic elastomer to enhance adhesion between the binder material and the solids to be added; (3) adding propellant solids including aluminum powder as a fuel element and two different nominal particle sizes of ammonium perchlorate oxidizer, to increase particle packing efficiency, to the solution of elastomer; (4) mixing the solids and the thermoplastic elastomer solution to achieve a uniform mixture; (5) evaporating the organic solvent from the mixture to yield a dry solid propellant composition free from the volatile organic solvent; (6) chopping the dried solid propellant composition into pellets; (7) placing a predetermined amount of the pellets in a mold and heating to 150° C. to yield a viscous fluid of the propellant composition; (8) pressing the viscous fluid in the mold; and, (9) cooling the mold and separating solid propellant, as grains from the mold.

U.S. Pat. No. 4,019,933 discloses isocyanate-cured propellant systems comprising a binder of hydroxy-terminated liquid polymer systems, selected plasticizers, optional metal fuels, and ammonium perchlorate. U.S. Pat. No. 4,090,893 describes a bonding agent system for improving aging and low temperature physical properties of propellant systems and compositions comprising hydroxy-terminated polybutadiene elastomers curable with a diisocyanate curing agent and containing aluminum metal fuel and ammonium perchlorate. Incorporation of the bonding agent system is accomplished utilizing conventional propellant blending and mixing equipment. And U.S. Pat. No. 4,597,924 describes a process for improving the mechanical properties and processability of thermoplastic propellant systems by incorporation of 0.1% to 1.0% organic titanates disclosed to function as a bonding medium between the surface of ammonium perchlorate particles and the thermoplastic elastomer.

OBJECTS OF THE INVENTION

It is an object of this invention to provide free-flowing particulate products useful for the production of propellants characterized as being fine sized and spheroidal in nature and highly chemically homogeneous; each particle having essentially the same content of fuels, binders and non-binder components.

It is further an object of this invention to provide fine sized fuel comprising particles characterized such that when admixed with oxidizer particulates and binders the particles will free-flow to fill the void spaces existent between adjacent oxidizer particles.

A still further object of this invention is to provide a fine sized spheroidal fuel comprising particles characterized as being thermally and/or chemically highly cohesive one particle to another and highly adhesive to the oxidizer particles contained in the formed propellant shape.

It is further an object of this invention to provide a spheroidal fuel comprising particle wherein the solid non-elastomeric components are bound together by one or more coagulated substantially polymerized monomers.

It is further an object of this invention to provide a spheroidal fuel comprising particulate characterized as comprising one or more coagulated substantially polymerized monomers capable of undergoing post-forming curing reactions as by molecular cross-linking, thereby obtaining improved propellant performance properties.

BRIEF SUMMARY OF THE PRESENT INVENTION

The above and other objects of the present invention are achieved by a method by preparing a free-flowing, particulate fuel component for use in solid propellant systems, which comprises: dispersing particles of a solid fuel having a particle size in the range of about 2–100 microns in a latex of a polymer and spray-drying the resultant dispersion. The polymer coagulates about the particles of fuel during spray drying.

The present invention also contemplates the free-flowing, particulate fuel component prepared by the method of the invention.

DETAILED DESCRIPTION OF THE INVENTION

Solid fuels suitable for practicing the present invention are typified by powdered charcoal, aluminum, beryllium, or the like. The fuel particles, prior to treatment with the polymer latex, have a particle size in the range of about 2–100 microns and preferably in the range 5–50 microns. Materials of smaller particle size are generally difficult to handle in conventional systems, but disperse easily in a latex system. Fuel particles larger than about 100 microns are undersirable from an overall performance basis. The fuel particles, particularly those of the light metals, may be pretreated in a conventional manner to increase their stability to water and make them more readily dispersible in the latex.

The fuel particles are dispersed in the latex by mixing using conventional mixing equipment. Without limiting our invention to a particular theoretical mode of operation, it is believed that the polymer in the latex adheres to and can be said to coat or form a coating on the particles of the fuel components and agglomerates to form a spherical particle when heated to near or above its glass transition temperature during drying.

Latexes of rubbery polymers are well-known to those skilled in the art. Latexes of synthetic polymers, particularly of the butadiene-styrene type, and other elastomeric polymers such as neoprene, nitrile and the like, are commercially available. Such latexes usually contain a variety of conventional additives including vulcanizing or curing agents. The presence of such agents in the latex may promote the further vulcanization or curing of the polymer when the dispersion of the fuel component in the latex is spray dried in the second step of our process. It is apparent that the method of the present invention can be practiced with a wide variety of latexes that coagulate on spray drying to form free flowing, particulate spheroidal products.

The polymers in the latexes used in practicing the method of the present invention have a glass transition temperature (Tg) between about −20° C. and +30° C. The glass transition temperature is that temperature at which a polymer changes from a hard, glassy state to a free-flowing, amorphous state. The specific glass transition temperature of a polymer is one measure of the polymer's softness and film-forming characteristics. Generally speaking, polymers with a glass transition temperature above 30° C. do not form films at room temperature. A decrease in glass transition temperature results in an increase in softness, elasticity and tack, and polymers with a glass transition temperature below −20° C. are too tacky and do not form free-flowing particulates when a latex containing them is spray dried. In practice of this invention, latex polymers having higher glass transition temperatures may be used, since product temperatures of 80°–100° C. are easily attained during spray drying.

In spray drying, water is removed from the system being dried to form a particulate solid. The system is first finely divided or "atomized" by passage through a nozzle or nozzles and the "atomized" product is then contacted with a heated gas. The heated gas functions to provide heat for evaporation of the water and serves as a carrier to remove the water vapor formed by evaporation. One skilled in the art can utilize conventional spray drying equipment to practice the method of the present invention and, within limits, control particle size distribution.

In practicing the method of the present invention, finely divided particles of the fuel and any adjuvants are dispersed in the latex of the polymer having the requisite glass transition temperature. The fluid dispersion is then formed into spheroidal droplets by nozzle or rotary means in the presence of a heated gas medium to vaporize the water and to produce a finesized, solid spheroidal product comprising the particles of the fuel and any adjuvants used encapsulated and all bound together by means of the rubbery polymer coagulated on the fuel.

The free-flowing particles produced by the method of the present invention are particularly suited for use as fuel and binder components in the production of propellants. The products of this invention may be utilized as a source of the fuel and the binder in conventional propellant processing systems, and may be admixed directly with oxidizer particulates and binders to form a free-flowing formable and curable propellant composition.

Our invention is further illustrated by means of the following non-limiting examples:

EXAMPLES

In each of the following examples, the feed to the spray dryer was prepared by dispersing in a butadiene-styrene latex an aluminum powder stabilized against reaction with water. The aluminum powder with a particle size less than 45 microns was prepared by sieving Alcan 44, a product sold by Alcan-Toyo America Inc. The latexes utilized were commercially available styrene-butadiene latexes (Dow Designed Latexes Brochure Form No. 191–183–86) having glass transition temperatures (Tg) ranging from −5° C. to +11° C. The properties of the "dry" polymers in those latexes are summarized below:

| EXAMPLE NO. | LATEX NO. | Tg(°C.) | TENSILE STRENGTH | DEGREE OF ELONGATION |
|---|---|---|---|---|
| 1 | DL 239A | −5 | 1025 psi | 420% |
| 2 | DL 240A | −1 | 1265 | 425 |
| 3 | DL 238A | 9 | 2050 | 360 |
| 4 | DL 245A | 11 | 3070 | 290 |

After mixing the aluminum powder with each latex, the resultant dispersions were spray dried using a spray dryer known in the trade as a Niro Mobile Minor having a three foot spray diameter. A two fluid nozzle spraying upward and operating at 30 psig was used to produce spheroidal droplets of the material being fed to the dryer. Approximately one percent by weight of a finely divided silica, known as Cabosil, was added as an anti-caking agent through a rotary atomizer located in the roof of the drying chamber. In all tests, the feed rate was maintained at about 3.7 kilos per hour, and the inlet temperature was kept at about 225° C. to obtain an outlet temperature of near 100° C. Nitrogen was used as the heat conveying gas and to operate the two fluid nozzles for feed atomization. About 80% of material fed to the spray dryer was recovered as dry product. Some deposits are formed on the walls of the spray drier due to the small size of the equipment. An essentially quantitative product yield is to be expected in commercial scale spray drying operations.

Spray drying of the dispersions yielded spheroidal particles having a mean particle size of approximately 50 microns and which contained approximately 61% by weight of aluminum metal. Some loose agglomerates having an average particle size of approximately 200 microns were also present. The free-flowing particles may be used, for example, as a fuel component and a binder in the preparation of propellants using procedures as described in U.S. Pat. Nos. 4,090,893 and 4,597,924, the disclosures of which are incorporated herein by reference. In U.S. Pat. No. 4,090,893, the propellant contains a high solids loading of aluminum metal (0–20%) and ammonium perchlorate (65–88%), hydroxy-terminated polybutadiene binder (7–15%) with antioxidant (0.15–1%), diisocyanate curing agent (0.75–3%), plasticizer (0–4%), and burn rate catalyst (0.05–1.5%) and optionally, a delayed quick cure catalyst system of equal parts of triphenylbismuthine, MgO, and maleic anhydride (0–0.05 each). The particulate fuel components of the present invention may be used to supply the desired aluminum content and a portion of the binder system in propellant systems described in the aforementioned patents. The fuel components prepared according to the method of the present invention may also be used to supply the aluminum in propellant systems such as those of U.S. Pat. No. 4,597,924. Other uses and applications of the method and free-flowing particulates of the present invention will suggest themselves to those skilled in the art.

What is claimed is:

1. A method for preparing a free-flowing, particulate fuel component for use in solid propellant systems, which comprises: dispersing particles of a fuel for a solid propellant having a particle size in the range 2–100 microns in a latex of a polymer, and spray drying the resultant dispersion.

2. A method according to claim 1, wherein the polymer has a glass transition temperature between −20° C. and +30° C.

3. A method according to claim 1, wherein the particles of the solid fuel dispersed in the latex are coated with the polymer.

4. A method according to claim 1, wherein the polymer is coagulated about the particles of the fuel during spray drying.

5. A method according to claim 1, wherein the fuel is a light metal.

6. A method according to claim 5, wherein the light metal is aluminum.

7. A method according to claim 6, wherein the particle size of the fuel is in the range 5–50 microns.

8. A method according to claim 1, wherein the polymer is an elastomer.

9. A method according to claim 8, wherein the elastomer is a butadiene-styrene rubber.

10. A method according to claim 9, wherein the butadiene-styrene rubber has a glass transition temperature of −1° C.

11. A method according to claim 1, wherein the latex contains a vulcanizing or curing agent.

12. A method according to claim 11, wherein the polymer is partially vulcanized or cured during spray-drying.

13. The free-flowing, particulate fuel component produced by the method of claim 1.

14. The fuel component of claim 1, wherein the fuel is aluminum and the polymer is a styrene-butadiene rubber.

15. A solid propellant system comprising the fuel component of claim 13 and an oxidizing agent therefor.

16. A solid propellant system comprising the fuel component of claim 14 and an oxidizing agent therefor.

* * * * *